United States Patent [19]

Zickermann

[11] Patent Number: 4,763,594

[45] Date of Patent: Aug. 16, 1988

[54] MULTIHULL SHIP WITH SPRINGS

[76] Inventor: Gustav A. Zickermann, Cancelos de Penaferim, 2710 Sintra, Portugal

[21] Appl. No.: 33,227

[22] Filed: Apr. 1, 1987

Related U.S. Application Data

[63] Continuation-in-part of Ser. No. 749,935, Jun. 27, 1985, abandoned.

[30] Foreign Application Priority Data

Jun. 28, 1984 [PT] Portugal ..... 78809

[51] Int. Cl.[4] ..... B63B 1/14; B63B 1/28

[52] U.S. Cl. ..... 114/61; 114/272; 114/279

[58] Field of Search ..... 114/274, 279, 280, 283, 114/61, 272, 273

[56] References Cited

U.S. PATENT DOCUMENTS

| | | | |
|---|---|---|---|
| 2,906,228 | 9/1959 | Wendel | 114/280 |
| 3,026,841 | 3/1962 | Pender | 114/283 X |
| 3,191,566 | 6/1965 | Wilben et al. | 114/274 X |
| 3,998,176 | 12/1976 | Stout et al. | 114/61 X |

FOREIGN PATENT DOCUMENTS

| | | | |
|---|---|---|---|
| 469983 | 8/1914 | France | 114/283 |
| 16994 | of 1914 | United Kingdom | 114/279 |

*Primary Examiner*—Sherman D. Basinger
*Attorney, Agent, or Firm*—Ladas & Parry

[57] ABSTRACT

A multihull ship has springs which, after each movement of the ship at sea, help the combined forces of gravity and flotation re-establish her equilibrium. This makes it possible to combine different types of spring actions, so that the hulls will have the movements best suited to the undulatory movements of the surface of the sea and best suited for achieving minimum drag.

2 Claims, 10 Drawing Sheets

I-I

J-J

MULTIHULL SHIP WITH SPRINGS

CROSS REFERENCE TO RELATED APPLICATIONS

This is a continuation-in-part of co-pending but then abandoned U.S. application Ser. No. 749,935 filed June 27, 1985.

TECHNICAL FIELD

The present invention relates to seagoing vessels, and, more particularly, relates to a device for stabilizing and maintaining the equilibrium of multihull ships while at sea.

BACKGROUND OF THE INVENTION

There are several previous disclosures describing multihull ships having connections which enable relative movements between hulls.

Some prior constructions consider the use of resilient suspension blocks. Such means are efficient for shock absorbing, but not for providing better dynamic stabilities of ships at sea. For an improved stability, movements between hulls in accordance with the sizes of the waves at sea are necessary.

Regarding prior constructions with pivoting arms, which enable movements between hulls of large amplitudes, the difficulty arises from the fact that such prior constructions consider movements which are controlled by hydraulic cylinders, mechanical stops, set screws, or other mechanisms that provide clearly defined relative movements or clearly defined end positions of such movements.

The use of complex mechanisms for transmitting movements between hulls, rigid stops, or bulky constructions without resilient restoring members cannot sufficiently ballance the movements between hulls with all kinds and velocities of sea waves.

This invention provides a simple and comparatively small arrangement of pivoting arms and spring means, which improves the seaworthiness of a multihull ship and enables quick acceleration and high speeds.

This invention enables very large relative movements of the hulls of a ship, both in the pitch and in the heave modes. Movements in pitch mode are important because the different hulls of a multihull ship at sea will meet the waves at different points and with different slopes. Movements in heave are important because the waves, at different points of the ship, will have differents heights.

Previous constructions also have the shortcomings of providing interrelated motions.

With pivoting axes parallel to the length of the ship, each time such arms swing up and down, they also swing close to or away from the hulls, meaning that relative movements in heave are interrelated with relative and simultaneous movements in sway. With pivoting axes at right angles to the length of the ship, each time the arms swing up and down, they also swing forwards and backwards, meaning that relative movements in heave are interrelated with relative and simultaneous movements in surge.

This invention solves this problem because each one of the connections between hulls is made by at least two arms having the free ends interconnected with bearings which are not firmly secured in any particular position. Short arms can be used for producing movements in any direction and such movements may have large amplitudes. Such short arms and the simple direct movements in accordance with the direction of the forces of the waves provide significantly better frequency responses than bulkier constructions and interrelated movements.

Another drawback of previously disclosed structures with pivoting arms is related to the fact that the movements and relative positions of the hulls of such ships are defined by means of hydraulic cylinders, mechanical stops or other mechanisms.

Ships in which several hulls are forced into simultaneous motions are not ideal because much large masses have to be accelerated. The reaction is significantly slower than if each hull of a ship can move independently.

In this invention, better frequency responses are achieved because the springs will not force any hull to move in any particular direction each time a wave is forcing another hull of the same ship to heave and pitch in accordance with the forces produced by that wave.

The present invention is useful.

Conventional ships, to be really seaworthy and to have an acceptable drag, have to be very large and slow. Preferably over 40,000 tons deadweight, with speeds under 30 knots. Such large and slow vessels are only convenient for the transportation of raw materials and other goods that are traded in huge quantities. On land, transportation by rail or road takes place at speeds and volumes which are much more convenient.

At sea, surface effect ships are capable of such speeds, but have various shortcomings. Lift forces provided by air are not convenient for large vehicles. Surfaces become too large. This is also true for airplanes. Typically, commercial airplanes have payloads of less than 120 tons and cruising speeds just below the speed of sound. For increased payloads, wings or larger sizes would be necessary. As such larger wings are of heavier constructions, there is a limit above which it becomes impossible to build larger aircraft, unless supersonic speeds are adopted. But such high speeds are neither economic nor convenient for short and medium distances which are the ones that require mass transportation.

If lift force is produced by water instead of air, it becomes easy to build very large vehicles. The present invention enables the construction of ships with payloads between 1200 and 4000 tons and cruising speeds between 150 and 250 knots. Such ships will be very convenient for the average type of traffic.

For speeds under 30 knots, monohull ships have less drag than multihull ships. But, whenever seakeeping qualities are more important than the relation between weight and drag, the invention enables the construction of light deplacement ships having seakeeping qualities superior to the ones of much larger monolithic (monohull or multihull) ships.

SUMMARY OF THE INVENTION

It is an object of the present invention to enable each hull to heave and pitch easily over the waves, and thus allow seagoing ships with hulls designed for planing on the water surface to be built.

It is an additional object of the present invention to enable the construction of very seaworthy multihull ships, a construction that prevents capsizing and breakages, even if such ships are very lightly built.

It is an additional object of the present invention to avoid breakages also if, at extremely high speeds, such ships hit solid objects floating at the surface of the sea. Such objects are often too small for an early detection by electronic means to be made, so that a collision could be avoided by turning the ship.

It is an additional object of the present invention to enable the construction of extremely fast oceangoing ships able to carry passengers and cargo without submitting the passengers and the cargo to exaggerated vertical accelerations.

It is an additional object of the present invention to enable the construction of extremely fast oceangoing ships which have a minimum of drag.

The invention relates to a multihull ship having springs. The springs ensure stability of the multihull ship while at sea. According to the invention, the springs are connected to assemblies, each assembly having at least two pivoting arms which are connected to the ship's hulls.

For connecting adjacent hulls, each one of the preferred assemblies has only two of its pivoting arms connected to the hulls.

For connecting a fully emerged main hull to a planing hull, each one of the preferred assemblies has two pivoting arms connected to one of the hulls and another pivoting arm connected to the other hull.

The springs besides holding the pivoting arms in a normal equilibrium position, also enable the hulls to heave and pitch in accordance with the waves so that planing hulls can be used.

For a further reduction of drag forces, the invention also relates to planing vanes, connected to planing hulls by means of springs. Such springs enable the vanes to move up and down at high speeds, so that ideal angles of attack for producing very high lift forces with a minimum of drag are achieved.

DESCRIPTION OF THE DRAWINGS

The accompanying drawings

The accompanying drawings

FIG. 1 is a longitudinal sectional view taken along lines A—A in FIG. 2. It shows, from the starbord side, one hull of a multihull ship with springs.

FIG. 2 is a horizontal sectional view of a preferred embodiment of the invention taken along lines B—B in FIG. 1.

FIG. 3 is an elevational view of another preferred embodiment of the invention.

FIG. 4 is a front elevation of the embodiment of FIG. 3.

FIG. 5 is an enlarged fragmentary elevational view of the embodiment shown in FIGS. 3 and 4, showing portions of the main hull and of one of the planing hulls together with one of the assemblies connecting these hulls.

FIGS. 6, 7, 8 and 9 are enlarged transverse sectional views of the pivoting connections represented in FIG. 5. In FIG. 9 the enlargement is greater than in the previous figures.

FIG. 6 is a fragmentary sectional view taken along lines A—A in FIG. 5.

FIG. 7 is a fragmentary sectional view taken along lines B—B in FIG. 5.

FIG. 8 is a fragmentary sectional view taken along lines C—C in FIG. 5.

FIG. 9 is a fragmentary transverse sectional view taken along lines D—D in FIGS. 5 and 10.

FIG. 10 is a longitudinal sectional view taken along lines E—E in FIG. 9.

FIG. 11 is a horizontal sectional view taken along lines F—F of the fragment represented in FIG. 10.

FIG. 12 ia a horizontal sectional view taken along lines G—G of the fragment represented in FIG. 10.

FIG. 13 is a fragmentary longitudinal sectional view taken along lines H—H in FIG. 11.

FIG. 14 is a fragmentary transverse sectional view taken along lines I—I in FIG. 13.

FIG. 15 is a fragmentary transverse sectional view taken along lines J—J in FIG. 13.

FIG. 16 is a fragmentary side elevation of the fore end of a planing hull.

FIGS. 17, 18, 19 and 20 are longitudinal sectional views showing different positions of one planning hull relative to the main hull. The position of the main hull is represented by cross sections of its stub wings.

FIG. 17 shows one planing hull in its designed normal position relative to the main hull.

FIG. 18 shows an off-normal position of one planing hull rellative to the main hull.

FIG. 19 shows another off-normal position of one planing hull relative to the main hull.

FIG. 20 shows an off-normal position of one planing hull relative to the main hull, in which the pivoting arms are in a completely collapsed state.

DETAILED DESCRIPTION OF ILLUSTRATIVE EMBODIMENTS OF THE INVENTION AND BEST MODE FOR CARRYING OUT THE INVENTION

Two illustrative embodiments will be explained in detail.

Figure 1:
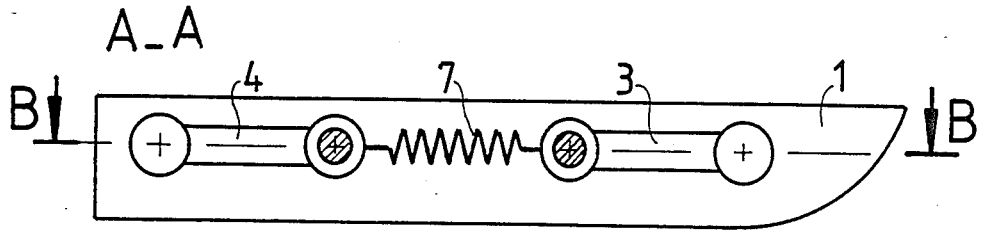
FIGS. 1 and 2 show a preferred embodiment of the invention, which includes two hulls 1 and 2 connected by assemblies of pivoting arms 3, 4, 5 and 6. The arms are held in equilibrium by springs 7 and 8. In this embodiment, the arms will be nearly horizontal.
Figure 2:
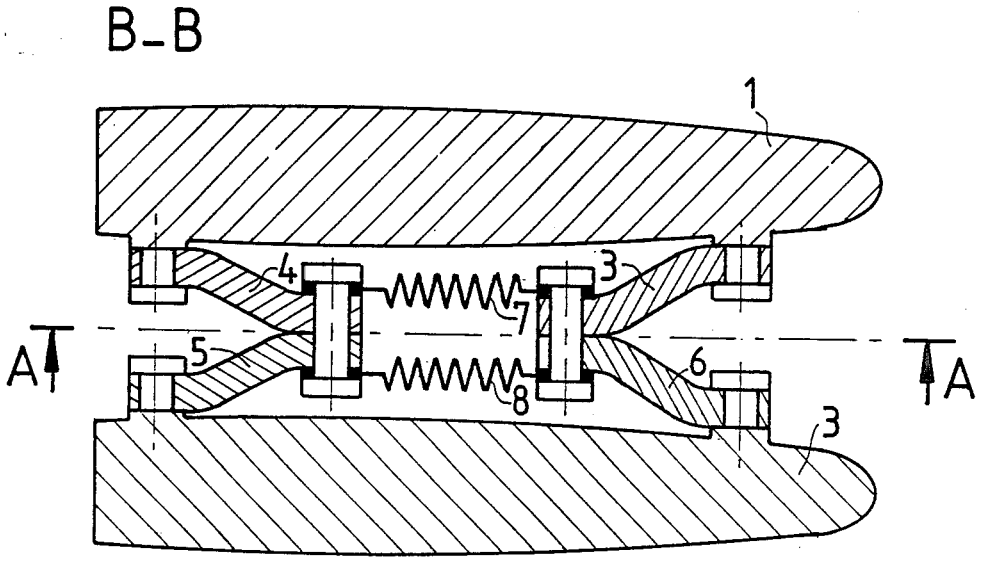

FIGS. 1 and 2 show an embodiment with two adjacent hulls 1 and 2 connected by two assemblies. One assembly has two pivoting arms 4 and 5, and the other assembly has two pivoting arms 3 and 6. One end of each one of the pivoting arms is connected to the ship's hulls and the other ends of every connection are interconnected with bearings.

The arms are held in equilibrium by two springs 7 and 8 which extend between the assemblies at their interconnecting bearings.

In FIG. 1 it can be seen that in this embodiment the spring 7 holds the arms 3 and 4 in a near horizontal position.

All pivoting axes of the arms are horizontal and at right angles to the length of the ship. Therefore, the hulls are secured against relative movements in sway and yaw.

If one of the arms of an assembly moves up and the other arm moves down, the sum of the pivoting movements produces a vertical motion of one hull against another hull. The bearings interconnecting arms 4 to 5 and 3 to 6 are not firmly secured in any paricular position. The arms are able to rotate freely. Arms are not obliged to move in parallel. Relative movements of the hulls, not only in heave, but also in pitch, are enabled. The sums of the pivoting movements of the arms can produce vertical motions, of one of the hulls against the other, of large amplitudes and in accordance with the sizes of the waves at sea.

The pivoting arms 3, 4, 5 and 6 also enable the interconnected hulls 1 and 2 to heel (or roll) simultaneously to the same side. Such rolling motions will be sincronous and the springs reestablish equilibrium. Energy is absorbed by the springs 7 and 8 when the hulls heel. This energy is not lost and ensures that the hulls will regain its upright equilibrium position.

Another type of rolling motion is produced when the complete ships heels. Such heeling is made possible by this invention in such a way that the individual hulls keep their upright position, whilst the pivoting arms unfold. Such type of rolling motion is equivalent to relative movements between hulls in the heave mode.

If, during one of the above relative movements between hulls, the arms will no longer remain horizontal, independent movements of the hulls in the surge mode are also possible. In this event, equilibrium is regained because such horizontal motions only become possible as the movements between arms progress. As the arms will be continuously swinging up and down, each time that the arms go through their initial position, relative off-normal positions due to surging are eliminated and the equilibrium position is regained.

Regarding heaving and pitching, it is the dynamic equilibrium that is important for safe seakeeping.

For calculating the speed range in which dynamic equilibrium is sufficient, the natural frequencies of the ship are compared with the expected frequencies of encounters with waves. Only waves which are large enough to upset the equilibrium of a ship need to be considered.

Conventional ships are calculateed so that the natural frequency for pitching is higher that the expected frequencies of encounters with waves. Calculations show that for sailing at high speeds large length to beam ratios are necessary.

But too large length to beam ratios are inconvenient for the transverse stability. Acceptable dynamic transverse stabilities can be achieved by using natural frequencies for rolling, which are either lower or higher than the expected frequencies of encounters with waves.

At sea, longer waves are less frequent than shorter ones. For the very large and heavy monohull ships, natural frequencies for rolling are adopted which are lower than the probable frequencies of encounters with waves. The same solution cannot be used with smaller ships. Light desplacement ships need a considerable beam for ensuring that the natural frequency for rolling will be high.

The problem arises from the fact that, if a ship has a certain displacement, for increasing the beam it becomes necessary to decrease the length. Ships with an insufficient length have a too low natural frequency for pitching. Such ships are not able to follow quickly the slopes of waves and they are only suitable for low speeds.

Multihull ships with long and widely spaced hulls apparently solve this problem. In reality, if all hulls of such ships are obliged to oscillate in unison, the problem is not solved. As the different hulls are widely spaced, hydrostatic and hydrodynamic forces do not work in unison, and quick reactions are not achieved. For average wave patterns, the natural frequencies for heaving and pitching of a rigid multihull ship is considerable lower than for a monohull ship of comparable length and displacement.

Low natural frequencies for pitching and heaving are very serious shortcomings. Usual tactics for riding out gales at sea may be not be sufficient for avoiding resonance between the motions of such ships and the frequency of encounters with waves. Ships having the hulls connected by mechanisms or devices that limit independent and free relative movements in the pitch and heave mode are, from a dynamic point of view, equivalent to rigid multihull constructions.

The embodiment shown in FIG. 2 has two hulls with a wide spacing between them. This embodiment does not suffer from the shortcomings of having a comparatively low natural frequency for heaving and pitching. In fact, as the hulls are able to heave and pitch independently, their natural frequencies are equivalent to the natural frequencies of monohull ships. The considerable advantage over monohull ships is achieved, because hulls can be used, having a considerably greater length to beam ratio that the one that can be used for conventional monohull ships with a similar displacement. Higher speeds become possible.

Regarding the rolling motions, as the hulls are linked by pivoting arms which will oblige the hulls to roll synchronously, the natural frequency will be much lower than in conventional monohull ships. Only much larger waves than the ones which are dangerous for monohull ships of comparable weight will be able to cause resonant rolling motions. Such larger waves are so seldom that encounters at a resonant frequency can be easily avoided. Better seakeeping is achieved.

As the hulls are able to heave independently, a danger of capsizing does not exist, unless the arms become completely outstretched and the ship starts behaving like a monolithic structure. It is an important feature of this invention that this problem can be easily avoided by using arms of a sufficient length. As the vertical movements are due to sums of pivoting movements, arms of a length that would be cumbersome are not required. Furthermore, no strong springs are needed for holding such arms in equilibrium. Independent movements of the hulls are not hindered by the springs.

The embodiment represented in FIGS. 1 and 2 is useful for sailing safely at speeds much higher than the usual speeds of monohull ships of similar sizes, and also for duties at sea which do not require high cruising speeds but which do not allow the use of tactics for riding out gales. Such tactics consist in adjusting the speed and the course of a ship to the speed and course of the waves.

The embodiment of FIGS. 1 and 2 has only two hulls. A larger number of parallel hulls can be used, and so the highest admissible speed for meeting waves would be increased considerably. Such an embodiment is not shown because ships having only parallel seaborne hulls have the following shortcomings.

One shortcoming is that the assemblies shown in FIGS. 1 and 2 are rigid for forces in the direction of the arms, whenever all its arms are pointing in the same direction. As can be seen in the accompanying drawing FIG. 1, the logical or, certainly, the most convenient position of such arms is, basically, a horizontal one. At sea, large waves require movements between hulls of great amplitudes. Long arms have to be used, and the best way for placing such arms is alongside the hulls. With arms placed parallel to the length of the ship, the connections are rigid for forces in the direction of the speed of the ship.

For ships at low speeds, such forces are not important. Water in waves moves basically up and down. So, although large waves move at high speeds, the forces being produced when they meet a ship are, basically, vertical. Only if the speed of the ship is high, horizontal forces, oposed to the ship's speed, become very important too.

A surging between hulls with amplitudes suficiently large for absorbing strong uneven horizontal forces cannot be provided by arms which are normally in a nearly horizontal position.

The other shortcoming is that the hulls of such ships, as they will be able to follow quickly the slopes of waves, will exhibit considerable vertical accelerations. Hydrostatic and hydrodynamic forces upon structural elements are reduced by means of the pivoting arms and springs shown in FIGS. 1 and 2, but not the forces due to accelerations acting upon passengers and loosely stowed cargo. Ships with the features of the embodiment shown in FIGS. 1 and 2 can be used for supporting machinery, such as the ocean thermal energy conversion plants described in the January 1987 issue of "Scientific American". They do provide safe seakeeping for such plants. But they cannot provide confortable transportation for passengers at very high speeds amidst rough seas.

The accompanying FIGS. 3 to 20 show a preferred embodiment of the invention for sailing at very high speeds.

In ships, sailing in rough seas, two completely different types of disturbing forces have to be considered. One type is of hydrostatic nature. Hydrostatic pressures are, in surface ships, extremely weak. For carrying the weight of a ship, very large surfaces are required. The other type of force is of hydrodynamic origin. At high speeds, hydrodinamic pressures are very high. For carrying the weight of a ship, only very small surfaces are required. It is not advisable to use the same type of surfaces for low and high speeds.

Figure 3:
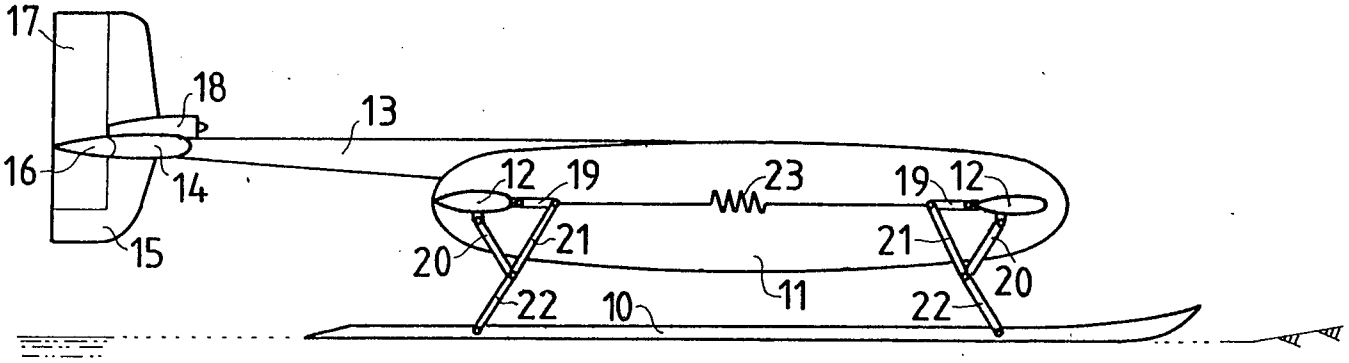
FIGS. 3 to 20 show another preferred embodiment of the invention, which includes a main hull 11 supported by several long planing hulls 10. The main hull has stub wings 12, boom 13, tailplane 14, skeg 15, elevator 16, rudder 17 and turbopropeller engines 18. The connection between the main hull and the planing hulls are made by assemblies, each one having four pivoting arms 19, 20, 21 and 22. The arms are held in equilibrium by springs 23. Each planing hull 10 has a large number of planing vanes 24 secured by springs 25 and 26.
Figure 4:
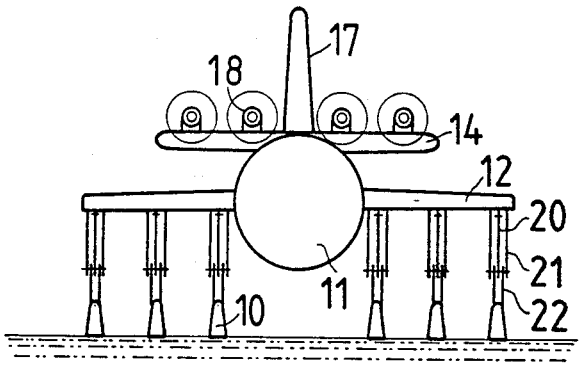

In FIGS. 3 and 4 it is shown that the main hull 11 should be large. The main hull has a long boom 13, securing turbopropeller engines 18, rudder 17, skeg 15, and tailplane 14. Tailplane 14 is used for stabilizing the horizontal equilibrium at high speeds. Fine tuning or horizontal stability can be provided by means of elevator 16. The skeg 15 is useful if speeds become so low that the main hull becomes seaborne and a control by means of aerodynamic forces becomes impossible.

At high speeds, lift force is provided by means of planing hulls 10 which have considerably smaller surfaces than the main hull 11. A suspension system, with pivoting arms and springs, transmits the required lift force to stub wings 12, which are firmly secured to the main hull 11.

Only the planing hulls 10 should follow the slopes of the waves. Means are required for distinguishing which hulls should heave and pitch and which ones should not. In this invention the distinction is made by using inertias of different orders of magnitude. The main hull 11 has a great mass and the planing hulls 10 are as light as possible.

The problem of providing vertical forces for supporting the main hull and, at the same time, enable vertical unhindered movements of the planing hulls is solved by using high cruising speeds and by providing a particular structure for connecting the main hull to the planing hulls. At high speeds, the lift forces that can be produced by each one of the planing hulls is several times larger that the weight of the main hull. The full amount of lift force which each one of the planing hulls 10 is able to produce will be available for providing easy heaving and pitching over the waves to the planing hulls. But, as only a fraction of this force is needed for supporting the main hull 11, forces not needed for supporting the main hull and that could produce unwanted movements of this hull are filtered out.

It is believed that the ideal cruising speed of the embodiment shown in FIGS. 3 and 4 will be between 150 and 250 knots. The long and light planing hulls are able to follow the slopes of the waves at such high cruising speeds. Furthermore, high speeds are convenient because the lift to drag ratio of the planing surfaces practically does not change with speed. Only the aerodynamic resistance increases with speed. For oceangoing ships over 1000 tons, with a streamlined main hull and ski-like planing hulls, the air and wind resistance at the above mentioned speeds is acceptable.

The lowest possible planing speed is reached when all the surface available for planing is used for providing such required lift force. If this lowest speed should be ten times smaller that the cruising speed, the required area is a hundred times larger that the wetted area at cruising speed.

For lower than planing speeds, it is possible to consider flotation by means of the main hull. Such flotation can be used in an emergency. Normally, such ships should stop on short runways ashore. Only a small distance is needed for decelerating and accelerating such ships from about 25 knots to zero and vice versa. The surface of such runways should not be abrasive. Low priced products, such as grease, snow, or grass can be used for protecting the planing surfaces against abrasion during landing and take off.

Figure 5:
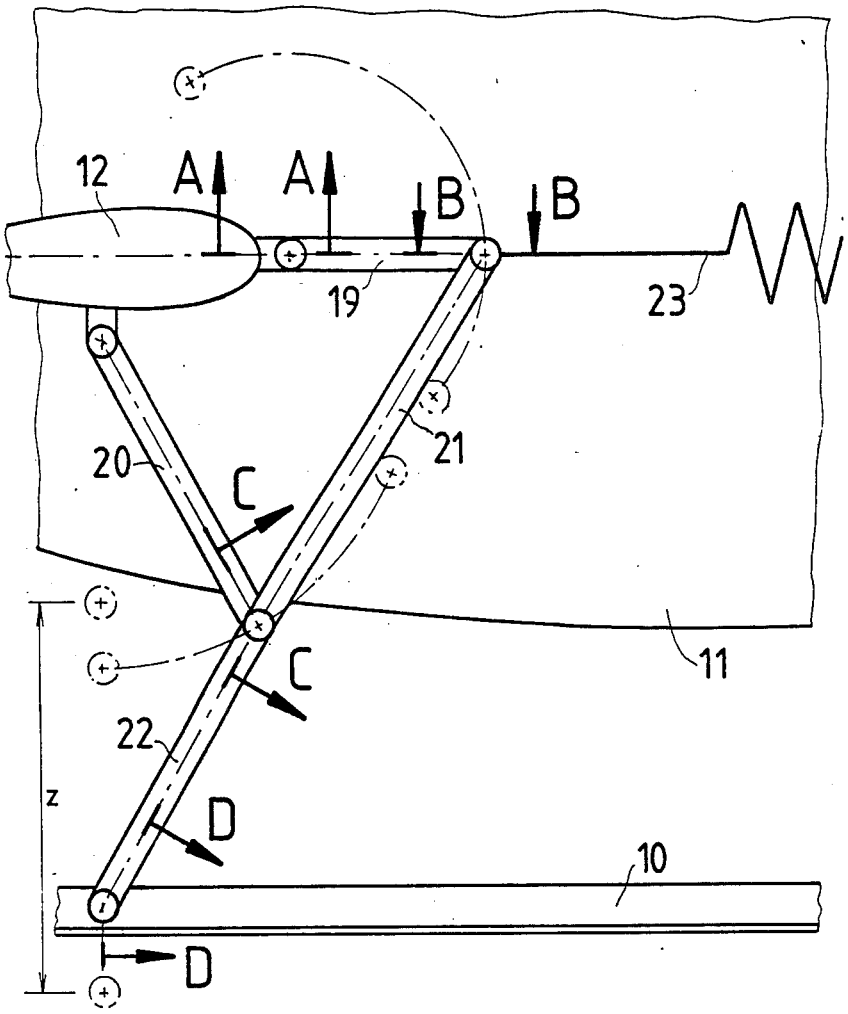

In FIG. 5 it can be seen that each one of the assemblies connecting a planing hull 10 to the main hull 11 has four pivoting arms: an upper suspension arm 19, a lower suspension arm 20, an intermediate arm 21, and a supporting arm 22. The suspension arms 19 and 20 are pivotally connected to stub wings 12 in such a way the the axes of the respective bearings are parallel and not conincident. The stub wings 12 are firmly secured to the main hull 10.

The upper suspension arms 19 are normally in a nearly horizontal position, to which they are forced by means of springs 23.

Figure 6:
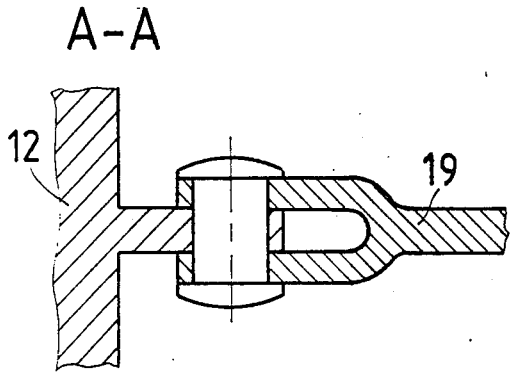

In FIG. 6 a joint between stub wing 12 and an upper suspension arm 19 is represented.

Figure 7:
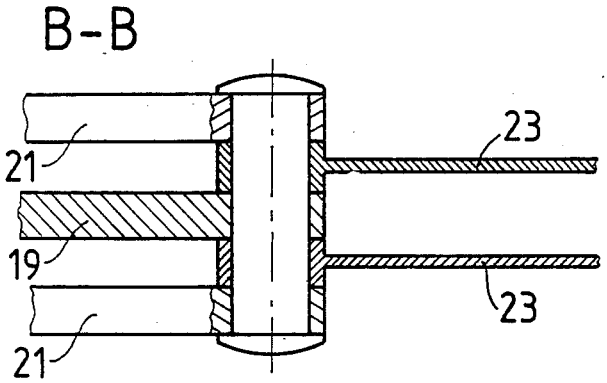

In FIG. 7 a joint between an upper suspension arm 19, two parallel springs 23, and an intermediate arm 21 is represented.

Figure 8:
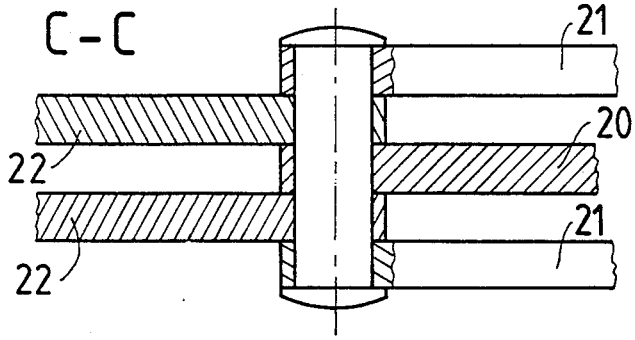
Figure 9:
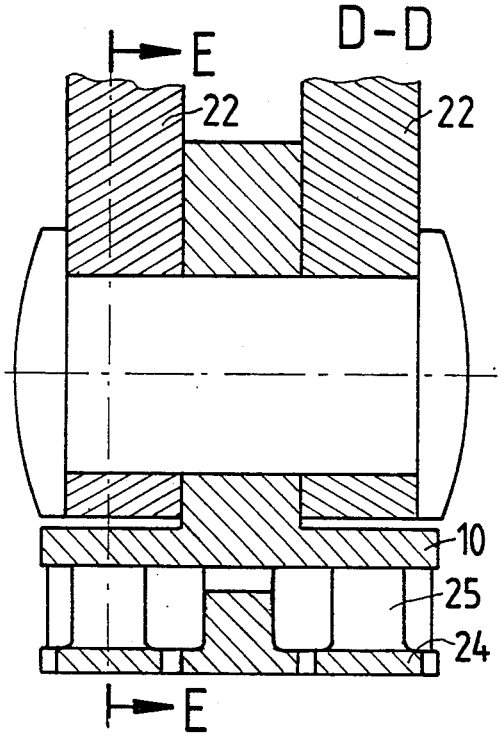

FIGS. 7, 8 and 9 show that arms 21 and 22 are made up by two equal parallel parts and that also two parallel springs 23 are used. Such constructions are to be preferred because they provide symetrical forces.

In FIG. 8 the joint between a lower suspension arm 20, an intermediate arm 21, and a supporting arm 22 is represented.

Figure 10:
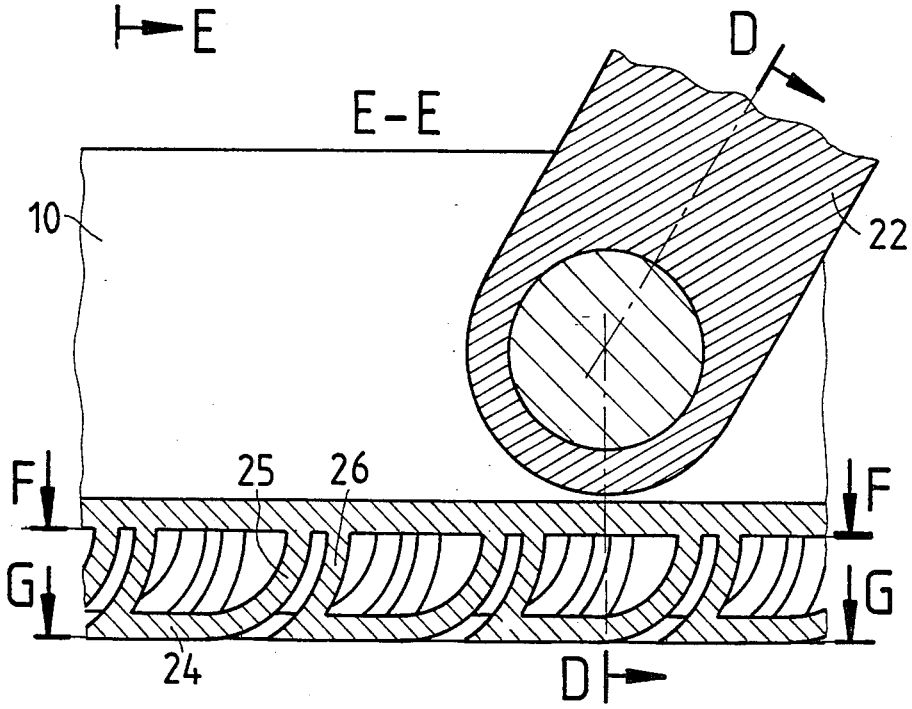

In FIGS. 9 and 10, the joint between a supporting arm 22 and a hull 10 with planing vanes 24, secured to the hull by means of springs 25 and 26, is represented.

All the pivoting joints of the arms have axes of the respective bearings placed horizontally and at right angles to the length of the hulls.

FIGS. 3, 17, 18, 19 and 20 show that two such assemblies are used for each planing hull 10.

A parallelism between the supporting arms 22 of the two assemblies is avoided. The thrust from engines 18 will be transmitted to the planing hulls by the supporting arm 22 that is pointing forwards. The structure enables the thrust to be transmitted without having to secure the arms in rigid positions.

Spring 23 extends horizontally between the bearings interconnecting the upper suspension arms 19 to the intermediate arms 21 of the two assemblies. One equilibrium position is clearly defined by an alignment of springs 23 with the upper suspension arms 19 of the two assemblies. Whatever the fraction of the weight of the main hull supported by the two assemblies of pivoting arms and whatever the movements of the arms, each time the planing hull 10 is unsupported by the water surface, arms 19, 20 and 21 return to their design equilibrium position, shown in FIGS. 3, 5 and 17.

Not so clearly defined are the movements of planing hull 10 and supporting arms 21. Three different types of movements are possible.

In FIG. 5 the letter z represents the amplitude of the movements which can be performed if the lower end of arm 22 moves up and down. One of the end positions, represented in FIG. 5 for the different arms, are reached when the lower suspension arm 20 and the supporting arm 22 become aligned. The other end positions, also represented in FIG. 5, are reached when intermediate arm 21 and the upper suspension arm 19 become aligned. If the lower ends of the two supporting arms 22, connected to one hull 10, move up at the same time, movements of that hull relative to the main hull 11 are in heave mode. If one of the lower ends moves up at the same time that the other end moves down, relative movements are in pitch mode.

Figure 18:
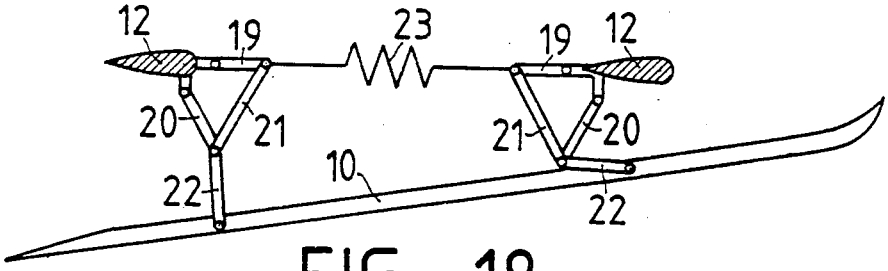

Another type of movement is represented in FIG. 18, and is due to rotations of the supporting arms 22. Such rotations are possible without any movements of the other three arms of each assembly and without any counteraction from spring 23, as can be seen by comparing FIGS. 17 and 18. Such rotations of the supporting arms 22 enable each one of the planing hulls to pitch easily over the waves without transmitting any pitching moments to the main hull. This is achieved by means of the opposed inclination of the supporting arms 22. During rotation, one of them becomes more vertical and the other one becomes more horizontal. The arm 22 that becomes horizontal ceases to be able to transmit vertical forces to the main hull. Lift force produced by a wavecrest is, by this means, shifted to the end of the planing hull which is in a trough.

Figure 19:
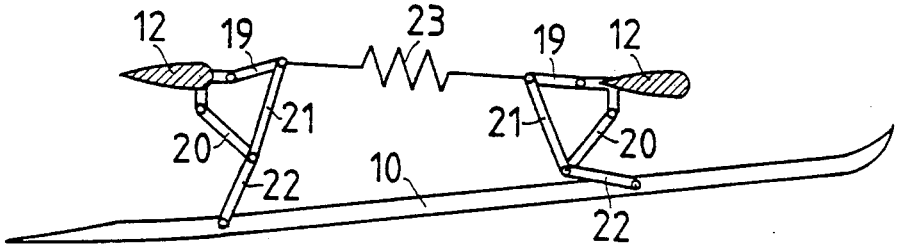

Comparing FIGS. 19 and 18, it can be seen that, if the water surface under the after end moves up, the after end of the planing hull 10 bends up, and the pivoting arms of the assembly connected to the same end of the hull move upwards. The intermediate arm 21 of the after assembly becomes more vertical and pushes the upper end of the supporting arm 22 forwards, towards its normal inclination. As the wave moves away from the fore end of the hull 10, the lower end of the fore support arm 22 will move down to its normal position. The normal equilibrium position will be re-established.

Figure 20:
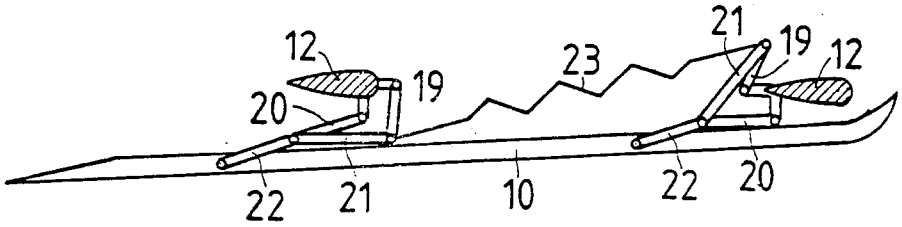

A third type of movement of the planing hull 10 is represented in FIG. 20. If horizontal forces should become exaggerated due to an impact against a solid object or an exceptionally steep wave, the two supporting arms 22 will rotate until both supporting arms 22 and both lower suspension arms 20 become nearly horizontal. In becoming horizontal the two lower supporting arms cease being able to transmit vertical forces to the main hull. Exaggerated lift forces are filtered out. In turning astern and up, the two lower suspension arms 20 force spring 23 into such a strong deformation that the normal position will be re-established automatically as soon as the hull 10 finishes its gliding movement over the obstacle that caused such hefty movement in heave and surge. During this hefty movement, energy is absorbed by the spring 23. When this energy is released for re-establishing the normal position for the planing hull 10, only a fraction of this energy is transmitted to the main hull 11 and converted by the mass of the main hull into a slow distrurbing movement that can be easily corrected by rudder 17 and tailplane 14 with elevator 16.

By increasing the number of planing hulls in a ship, the force required for each one of springs 23 can be decreased. By such means, constructions in which unwanted movements are filtered out very effectively can be achieved.

The normal cruising speed of ships built in accordance with this invention depends upon the speed of the vertical movements of the planing hulls 10 in response to sea waves. The planing hulls 10 should be manufactured in a lightweight and resistant material. Such hulls should be able to yield in response to uneven lift forces as shown in FIG. 19, and they should rebound very quickly.

Long, ski-like planing hulls are required because such a shape provides a good dynamic stability for pitch and heave, and a good directional stability for sway and yaw.

But a long continuous wetted surface should not be used. Only one per cent of the area of the bottom of the planing hulls of the ship is needed for supporting, at cruising speeds, the weight of the ship. Drag caused by friction of the remaining ninety-nine per cent of the surface trailing in the water cannot be tolerated.

FIGS. 9 to 16 show planing vanes 24 connected to the planing hulls 10 by springs 25 and 26.

Figure 11:
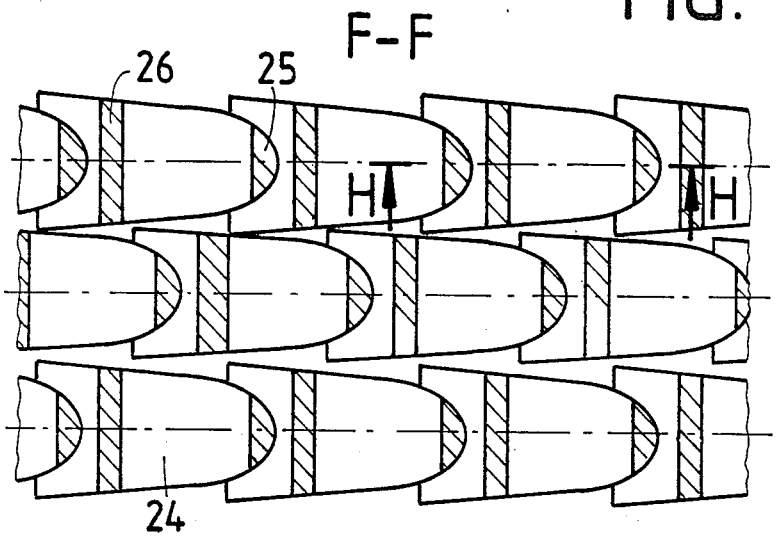

FIG. 11 shows the planing vanes 24 from above and cross sections of springs 25 and 26.

Figure 12:
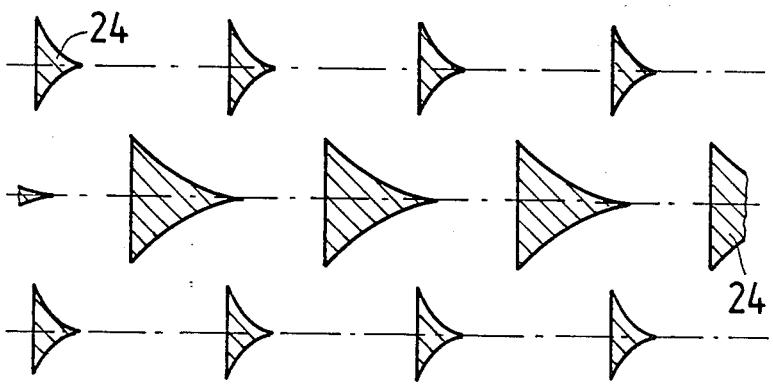

FIG. 12 shows the design waterplane of the planing vanes 24 at cruising speed. The vanes of the central row are more deeply submerged and carry most of the weight of the ship. The vanes at the sides are used mainly for recovering energy from the waves produced by the central vanes.

Long planing hulls, touching the water surface only with one per cent of their lengths, have the advantage that they will touch only the wavecrests, and normally only such wavecrests which are rising above other waves. The surface of the planing hulls will be normally making contact with water in an ascending movement. This feature is of great importance because it provides ideal angles of attack.

Such angles of attack can be obtained also if the planing surfaces move down, instead of the water surface moving up.

Springs 25 and 26 ensure that the vanes will be moving up and down very quickly. The vertical movements of the vanes are enhanced by the flexible construction of the planing hulls and by the assemblies with pivoting arms and springs connecting the planing hulls to the main hull.

For a certain lift force, the drag of a planing surface may change between very wide limits. For achieving an ideal lift to drag ratio, a minimum of deadrise, a carefully designed shape of the vanes, and a very specific angle of attack is required. A change of the angle of attack of only a fraction of a degree may produce a variation of the lift to drag ratio between values from 1000:1 to 10:1.

For keeping the lift to drag ratio of the lifting vanes near to 1000:1, which is an excellent value, it is necessary to adjust the angle of attack constantly to its ideal value. As the slopes of the sea surface change constantly, and also the directions of the speeds of the water and of the vanes will be changing constantly and between ample limits, the problem of adjusting the angle of trim so that the angle of attack will be ideal at all times is solved by this invention by taking as a reference or set value the pressure produced by the water upon each vane.

Figure 13:
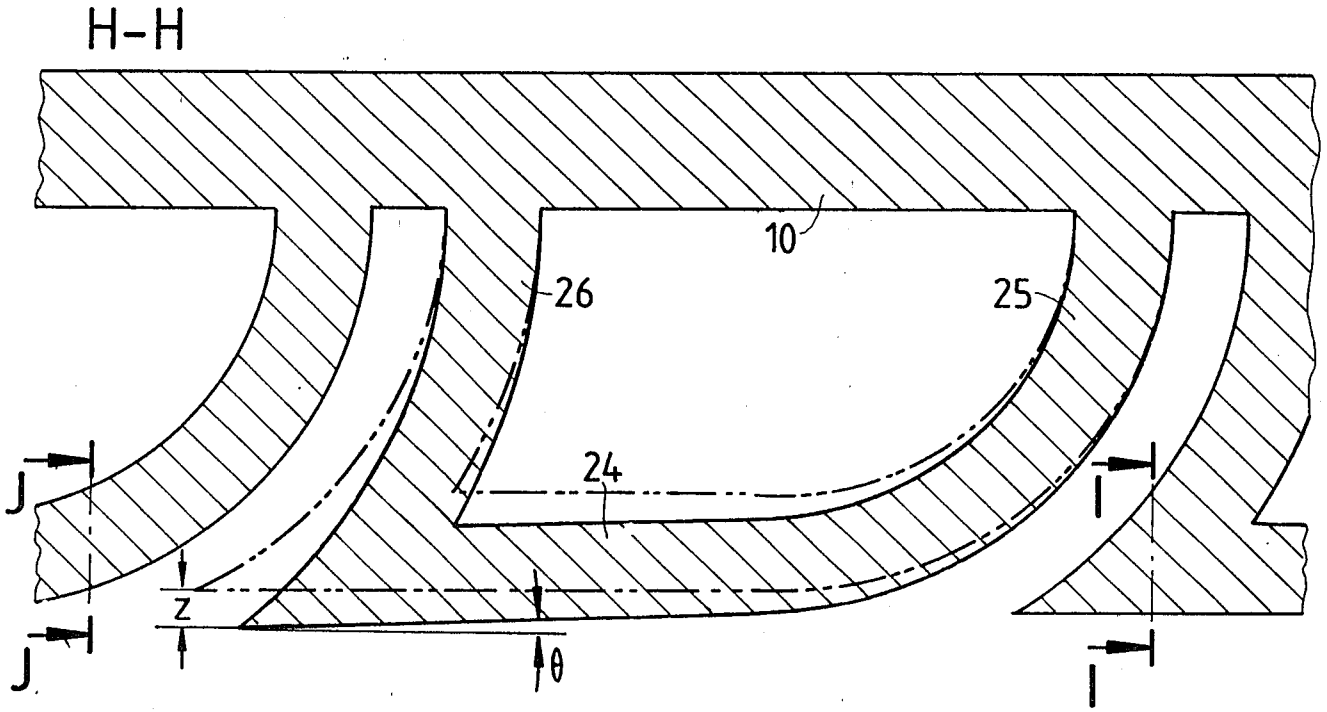

FIG. 13 shows that, if the pressure upon one vane becomes exaggerated, meaning that the angle of attack is exaggerated and that the drag by wave-making is exaggerated, the vane, being spring mounted, moves towards a reduction of the angle of trim ($\theta$ in FIG. 13). If the pressure upon one vane is too low, meaning that the angle of trim is too small and that the drag by friction is exaggertated, the vane moves towards a steeper angle of attack.

Under actual seagoing conditions, the vanes will be constantly moving up and down. Springs 25 and 26 should not be too short, so that movements with high speeds can be achieved. Such high vertical speeds are convenient at the instant the vanes touch the water. It is convenient to calculate the vibrating system so that, as each vane moves down, its forward end touches the water surface first. The combination of vertical movements of the vanes and movements for adjusting the angles of trim, provide ideal angles of attack, so that the required lift force will be produced under conditions that, on the average, provide the smallest possible drag. In fact, the planing vanes get an impulse from the water and afterwards they will stay in the air during a certain time.

Hulls 10, vanes 24, springs 25 and 26 can be manufactured using the same basic material. Seamless constructions should be preferred. Such constructions have been considered in the accompanying drawings FIGS. 9 to 16.

Figure 14:
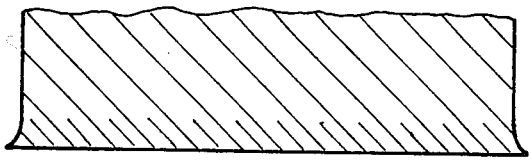

FIG. 14 shows that the trailing edge of vanes 24 is treated so that an extremely hard surface is achieved and that the angle of deadrise ($\beta$ in FIG. 15) should be practically imperceptible.

Figure 15:
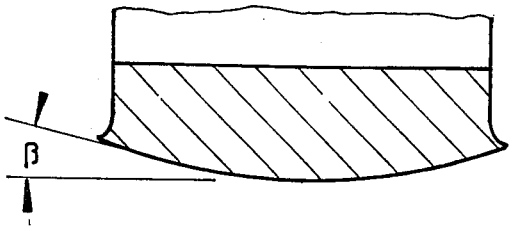

FIG. 15 shows that the bottom of the vane 24, near its fore end, has a curved bottom so that, at the middle of each vane, the angle of deadrise ($\beta$) will be also nearly imperceptible.

FIGS. 14 and 15 show, at the sides of vanes 24, a flare which is necessary for ensuring that the upper side of the vanes will normally not touch the water.

Figure 16:
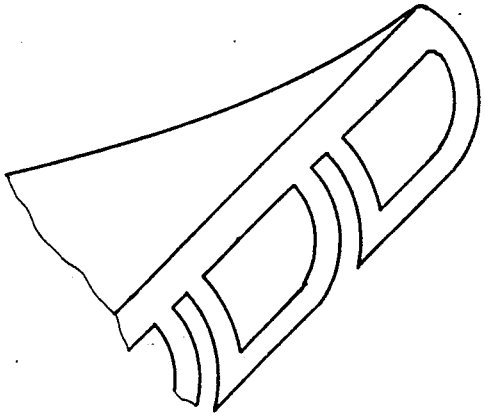
Figure 17:
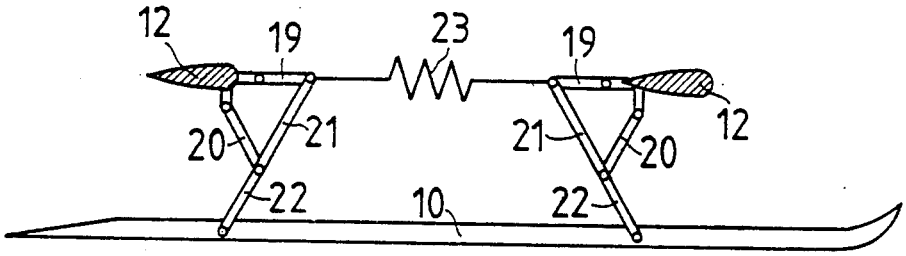

FIG. 16 shows that planing vanes 24 are used along the complete length of the planing hulls including its stems at the bows. The vanes are efficient for shock absorbing. FIG. 16 also shows that bows with considerable overhang have been considered.

A further reason for using a large number of lifting vanes 24 is related to the problem of noise. Small vanes provide only small concentrations of energy. It is expected that a ship, built in accordance with the features provided by this invention, will glide over the rough surfaces of the sea without producing a noticeable level of noise.

The idea of the vanes is to use the vanes as in an hydraulic machine. Furthermore, the assembly of vanes moves over the sea like a brush over the uneven surface of a suit. The idea of moving up and down is an additional feature. Computer calculations not yet made are needed to demonstrate drag reduction by jumping instead of gliding.

What is claimed is:

1. A multihull ship comprising, in combination:

(a) a plurality of elongated hulls;

(b) pivoting arm assemblies respectively between said hulls;

(c) at least one spring between said assemblies, each assembly comprising at least two pivoting arms, one end of one said pivoting arm being connected to one of said hulls and one end of the other said pivoting arm being connected to another of said hulls in such a way that said pivoting arms can rotate vertically, the axes of said rotation of said pivoting arms being basically horizontal and at right angles to the lengths of said hulls, the opposite ends of said pivoting arms being interconnected by a pivoting joint having an axis of rotation generally parallel to, but not coincident with the axes of said rotation of said pivoting arms, said pivoting arms being held in equilibrium about said pivoting joint by said spring, whereby the pivoting arms are able to move up and down easily and the sum of the pivoting movements enable relative movements of the hulls in heave and pitch, said spring holding said pivoting arms, when in equilibrium, in a substantially horizontal position.

2. A multihull ship comprising, in combination:

(a) several elongated, slim, lightweight and ski-like planing hulls and a much larger main hull having stub wings;

(b) at least two assemblies of pivoting arms supportingly connecting each planing hull to the stub wings of the main hull;

(c) at least one spring between the two assemblies of pivoting arms, each assembly of pivoting arms comrising four pivoting arms, two of the pivoting arms of each assembly each having one end connected to a respective one of the stub wings of the main hull by pivoting joints and one of the pivoting arms of each assembly having one end connected to one of the planing hulls by a pivoting joint in such a way that the pivoting arm can rotate in a vertical plane, the axes of the respective pivoting joints to the planing hulls being basically horizontal and at right angles to the lengths of the planing hulls, and, between the remaining ends of the two pivoting arms connected to the main hull, one, fourth, intermediate pivoting arm interconnecting with the remaining ends with pivoting joints, one joint of the intermediate pivoting arm being joined also to the remaining end of the pivoting arm connected to the planing hull, and the upper other joint of the intermediate pivoting arm being also connected to at least one spring, the axes of all pivoting joints interconnecting the arms being parallel to the axes of the pivoting joints connecting the arms to the hulls, and the interconnecting pivoting joints being not firmly secured in any particular position, but held in equilibrium by the springs so that the pivoting arm connecting said springs to one of the stub wings of the main hull is normally in a substantially horizontal position, and wherein said springs enable some of the pivoting arms of each assembly to rotate easily up and down and some other of the pivoting arms to rotate easily fore and aft, so that the sum of the pivoting movements enable relative movements of the hulls in heave and surge, and wherein the pivoting arm of each assembly connected to a planing hull is able to rotate without changing the deformation of said springs and so that, if one such arm turns into a more vertical position another such arm of another such assembly of the same hull will turn into a more horizontal position, so that exaggerated vertical forces upon one end of a planing hull are filtered out and wherein the two pivoting arms of each assembly which are connected to each planing hull can rotate into a more horizontal position, whenever horizontal forces upon the planing hull are exaggerated so that a considerable movement of the planing hull is performed in a surge mode, and wherein the main hull has control surfaces for reducing its unwanted movements and for steering the ship by means of aerodynamic forces at high speeds, each of the planing hulls having a number of planing vanes disposed in at least three rows, with the vanes of the center row slightly more submerged than the vanes of the lateral rows, the vanes being secured to the ski-like planing hulls by means of springs placed basically vertically, the ski-like planing hulls being of a flexible construction to enable, with additional flexibility provided by the spring mounted planing vanes, vertical movements of planing surfaces thereof so that the angle of attack of the vanes will be such that, on an average, a very favorable lift to drag relationship is achieved, the vanes having, at their sides, a flare such that, at high speeds, the upper sides of the vanes do not touch the water, the assemblies of pivoting arms connecting the main hull to the planing hulls are able to provide ample relative movements so that the planing hulls can pitch and heave easily over the waves and so that impacts against solid objects can be absorbed by means of movements in such of the planing hull that hit said object.

* * * * *

UNITED STATES PATENT AND TRADEMARK OFFICE

CERTIFICATE OF CORRECTION

PATENT NO. : 4,763,594

DATED : August 16, 1988

INVENTOR(S) : Gustav A. Zickermann

It is certified that error appears in the above-identified patent and that said Letters Patent is hereby corrected as shown below:

Figure 2, lower right, "3" should be -- 2 --.

Signed and Sealed this

Sixth Day of March, 1990

*Attest:*

JEFFREY M. SAMUELS

*Attesting Officer*

*Acting Commissioner of Patents and Trademarks*